United States Patent [19]

Pfortmiller

[11] Patent Number: 4,537,436

[45] Date of Patent: Aug. 27, 1985

[54] BOOT CARRIER

[76] Inventor: Donald D. Pfortmiller, 806 N. Crestway, Wichita, Kans. 67208

[21] Appl. No.: 591,062

[22] Filed: Mar. 19, 1984

[51] Int. Cl.[3] ..... B65D 63/18

[52] U.S. Cl. ..... 294/150; 294/148; 294/164; 294/165

[58] Field of Search ..... 294/137, 148–155, 294/157, 162–166, 170; 12/120.5; 211/34; 224/250

[56] References Cited

U.S. PATENT DOCUMENTS

| | | | |
|---|---|---|---|
| 2,428,074 | 9/1947 | Hanson | 224/250 X |
| 2,679,937 | 6/1954 | Fulster | 211/34 |
| 3,412,866 | 11/1968 | Binding | 294/162 |
| 3,775,794 | 12/1973 | Fisher | 294/164 X |
| 4,244,498 | 1/1981 | Copp | 294/162 |

FOREIGN PATENT DOCUMENTS

| | | | |
|---|---|---|---|
| 6342 | 12/1878 | Fed. Rep. of Germany | 294/165 |
| 2916392 | 11/1980 | Fed. Rep. of Germany | 294/165 |

*Primary Examiner*—Johnny D. Cherry
*Attorney, Agent, or Firm*—John H. Widdowson

[57] ABSTRACT

A boot carrier for carrying ski boots or the like comprising a handle including a pair of opposed ends, and a rope having two rope ends that are secured to the handle such as to define a closed loop. A generally hollow conduit spacer is provided and includes a pair of opposed open ends and a structure defining two pairs of spacer apertures. Each spacer aperture within each pair of spacer apertures is diametrical with respect to each other. The rope slidably passes through the two pairs of spacer apertures. The boot carrier also includes an elastic cord having a pair of cord ends secured to a pair of rope tightening end caps and is adapted for being positioned around the tops of the boots. The pair of rope tightening end caps is slidably positioned within the open ends of the conduit spacer such that tension on the elastic cord causes friction where the rope passes through the two pairs of spacer apertures in order to cause a tightening effect on the rope.

5 Claims, 8 Drawing Figures

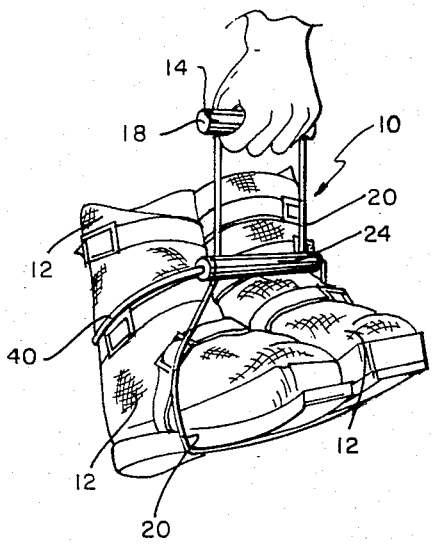
FIG. 1
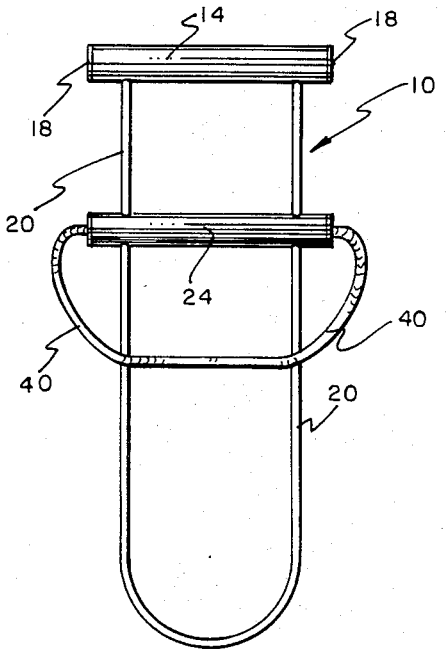
FIG. 2
FIG. 3
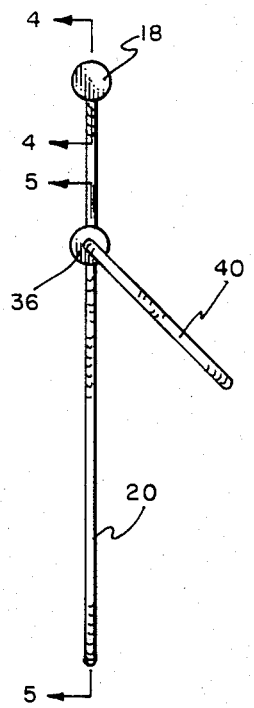

BOOT CARRIER

BACKGROUND OF THE INVENTION

1. Field of the Invention

This invention provides a boot carrier. More specifically, this invention contemplates a novel boot carrier for carrying ski boots or the like.

2. Description of the Prior Art

U.S. Pat. No. 3,775,794 by Fisher illustrates a ski boot holder which uses rigid holding means rather than holding means that are flexible in nature. U.S. Pat. No. 2,679,937 by Fulster illustrates a boot hanger and carrier wherein the carrier is flexible comprising straps engaging the boots around the instep and heel portion in an inverted manner so that the boots may be carried or hung or whatever. U.S. Pat. No. 2,428,074 by Hanson discloses a hanger or carrier similar to that shown in the Fulster patent. U.S. Pat. No. 3,412,866 by Binding discloses a ski boot jack and carrier wherein the boots are gripped in a rigid structure as shown in FIG. 2 of the drawings. None of the foregoing prior art teach or suggest the particular boot carrier of this invention.

SUMMARY OF THE INVENTION

This invention accomplishes its desired objects by providing a novel boot carrier for carrying ski boots or the like comprising a handle means including a pair of opposed ends, and a rope means having two rope ends that are secured to the handle means such as to define a closed loop. The boot carrier additionally comprises a generally hollow conduit spacer means including a pair of opposed open ends and a structure defining two pairs of spacer apertures. Each spacer aperture within each pair of spacer apertures is diametrical with respect to each other. The rope means slidably passes through the two pairs of spacer apertures. An elastic cord means is provided having a pair of cord ends and is adapted for being positioned around the tops of the boots. The boot carrier finally comprises a means secured to the cord ends and to the spacer means such that tension on the elastic cord means causes friction where the rope means passes through the two pairs of spacer means in order to cause a tightening effect on the rope means.

It is an object of the invention to provide a novel boot carrier which is capable of easily being assembled and disassembled and stored.

Still further objects of the invention reside in the provision of a boot carrier which can be easily transported, and is relatively inexpensive to manufacture.

These together with the various ancillary objects and features will become apparent as the following description proceeds, are attained by this invention, preferred embodiments being shown in the accompanying drawings, by way of example only, wherein:

BRIEF DESCRIPTION OF THE DRAWINGS

FIG. 1 is a perspective view of the invention secured to a pair of ski boots for carrying the same;

FIG. 2 is a front elevational view of the boot carrier;

FIG. 3 is a side elevational view of the boot carrier;

DETAILED DESCRIPTION OF THE INVENTION

Figure 4:
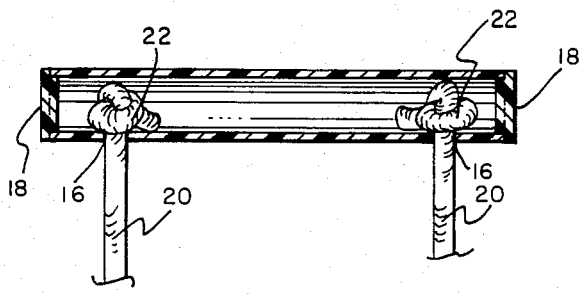
FIG. 4 is a partial enlarged vertical sectional view taken in direction of the arrows and along the plane of line 4—4 in FIG. 3.

Referring in detail now to the drawings, wherein like reference numerals designate similar parts throughout the various views, there is seen a boot carrier, generally illustrated as 10, for carrying ski boots, 12, or the like. Boot carrier 10 comprises a hollow cylindrical handle 14, having a pair of handle apertures 16—16 and a pair of end handle caps 18—18 that removably lodge on the opposed ends of the handle 14. Rope 20 has a pair of opposed ends 22—22 (see FIG. 4) that pass through the handle apertures 16—16 to define a closed loop and are knotted on the ends thereof in order to secure the same within the handle 14. Rope 20 can be removed from the handle 14 by removing the end handle caps 18—18 from the opposed ends of the handle 14 and reaching into the inside of the handle 14 to withdraw the knotted ends 22 in order that the same can be unknotted to pass through handle apertures 16—16. However, I find it desirable that end caps 18—18 be held permanently in place by either frictional fit or by gluing, with the desire that they stay in place and are not easily removed.

Figure 5:
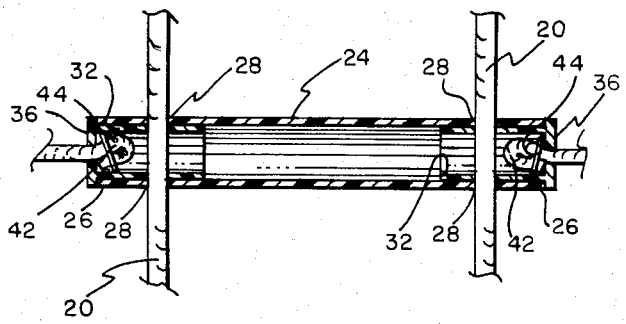
FIG. 5 is a partial enlarged vertical sectional view taken in direction of the arrows and along the plane of line 5—5 in FIG. 3.
Figure 6:
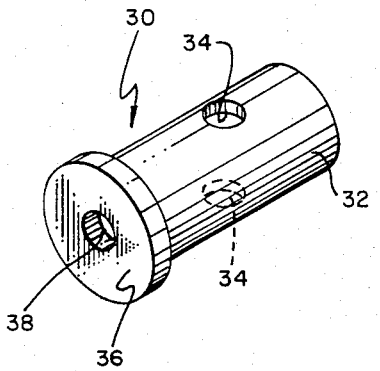
FIG. 6 is an enlarged perspective view of a rope tightening end cap.
Figure 7:
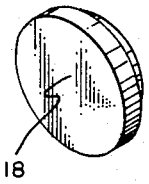
FIG. 7 is an enlarged perspective view of an end cap for the handle.
Figure 8:
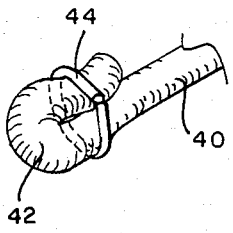
FIG. 8 is an enlarged partial perspective view of the end of the elastic cord which is wrapped with a metal ring in order to prevent the end from passing through the aperture of the rope tightening end cap.

A generally hollow conduit spacer 24 is provided and includes a pair of open ends 26—26 (see FIG. 5) and two pairs of spacer apertures 28—28, 28—28. Each spacer aperture 28 within each pair 28—28 is diametrically situated with respect to each other. A pair of rope tightening end caps, each generally illustrated as 30 (see FIG. 6), provides a means to cause a tightening effect on the rope 20 when the rope 20 passes through the two pairs of spacer apertures 28—28, 28—28. Each rope tightening end cap 30 has an inside cylindrical sleeve 32 with a pair of diametrically opposed cap apertures 34—34. A cap flange 36 is integrally bound to the cylindrical sleeve 32 and includes a flange hole 38 wherethrough the cord ends 42 of an elastic cord 40 pass. The cord ends 42 are bent into a cord loop, and a ring 44 fastens over each of the cord loops of the cord ends 42 in order to prevent the same from passing out and through the flange hole 38 of the cap flange 30.

The cylindrical sleeve 32 of the end cap 30 rotatably and slidably lodges within the pair of opposed open ends 26—26 of the conduit spacer 24 such that when the cap flanges 36—36 are flanged against the circumferential perimeter of the open ends 26—26 of the conduit spacer 24, the cap apertures 34—34 are in registry with their respective spacer apertures 28—28. The rope 20 slidably passes through the two pairs of spacer apertures 28—28, 28—28 and the respective cap apertures 34—34 of the pair of end caps 30—30 (see FIG. 5) in order that outward tension or force on the elastic cord 40 pulls the pair of end caps 30—30 outward. This causes friction where the rope 20 passes through the cap apertures 34—34 and respective spacer apertures 28—28 (see FIG. 5 again) which results in a tightening effect on the rope 20, thus increasing the amount of tension needed to pull the rope 20 through the conduit spacer 24.

With continuing reference to the drawings for operation of the invention, spacer 24 and handle 14 are held together in one hand. Then the lower loop of rope 20 is placed under the boots 12, preferably by placing the boots on the rope 20 with the other hand.

Spacer 24 is then brought down to the boot instep, and the elastic cord is placed over th boot tops. Handle 14 is grasped and the ski boots 12 are lifted. Spacer 24 is steadfastly held in place on rope 20 by the outward tension or force on the elastic cord 40 due partially from the weight of the boots 12 which slidably pulls within open ends 26—26, the pair of end caps 30—30 outward. This outward motion of the end caps 30—30 causes friction in apertures 28—28 and 34—34, where the rope 20 passes therethrough, resulting in a tightening effect on the rope 20 and an increase in the amount of tension needed to pull the rope 20 through the spacer 24. Actually, outward tension is applied to the end caps 30—30 as soon as the elastic cord 40 is placed around the boot tops, since the elastic cord 40 is being stretched while in this position. Thus, the end caps 30—30 tighten on the rope 20 even prior to the boots being lifted. When it is desired to remove the boots 12 from within the boot carrier 10, the boots 12 are placed on the ground in order to remove some of the tension from the elastic cord 40 which enables spacer apertures 28—28 to be partially registered with cap apertures 34—34 of both end caps 30—30; once elastic cord 40 is removed there is total registration. Rope 20 may now be easily slid through apertures 28—28 and 34—34 in order to remove the boots 12 from the boot carrier 10.

Thus, by the practice of this invention, there is provided a light weight boot carrier 10 (weighs less than 4 oz.) that can be put on or taken off boots 12 in seconds, that fits all types of ski boots 12 or the like, and that holds the boots 12 in their upright position so they can be set down anytime and anywhere.

While the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the scope of the invention as set forth.

I claim:

1. A boot carrier for carrying ski boots or the like, comprising:

a handle means including a pair of opposed ends;

a rope means having two rope ends that are secured to the handle means such as to define a closed loop;

a generally hollow conduit spacer means including a pair of opposed open ends and a structure defining two pairs of spacer apertures, each spacer aperture within each pair of spacer aperture being diametrical with respect to each other, said rope means slidably passing through the two pairs of spacer apertures;

elastic cord means having a pair of cord ends and adapted for being positioned around the tops of said boots; and means secured to said cord ends and to said spacer means such that tension on said elastic cord means causes friction where the rope means passes through the two pairs of spacer apertures in order to cause a tightening effect on the rope means.

2. The boot carrier of claim 1 wherein said means secured to said elastic cord means and to said spacer means comprises a pair of rope tightening end caps, each rope tightening end cap comprises an inside cylindrical sleeve having a structure defining a pair of diametrically opposed cap apertures and a cap flange integrally bound to said cylindrical sleeve and including a flange hole, wherethrough said cord end passes and is removably secured behind said end caps which rotatably and slidably lodge within the pair of opposed open ends of the conduit spacer means such that when the cap flanges are flanged against the circumferential perimeter of the open ends of the conduit spacer means the cap apertures are in registry with their respective spacer apertures and the rope means slidably passes through the two pairs of spacer apertures and the respective cap apertures of the pair of end caps in order that outward tension or force on the elastic cord means pulls the pair of end caps outward to cause friction where the rope means passes through the cap apertures and the spacer apertures which results in a tightening effect on the rope means and an increase in the amount of tension needed to pull the rope means through the conduit spacer means.

3. The boot carrier of claim 2 wherein the cord ends are each bent with a cord loop, a ring means fastens over each of the cord loops of the cord ends in order to prevent the cord ends from passing through the flange hole of the cap flanges.

4. The boot carrier of claim 3 wherein the handle means is generally hollow and cylindrical and includes a pair of handle apertures wherethrough said two rope ends of said rope means pass and are knotted on the ends thereof in order to secure the same within the handle means.

5. The boot carrier of claim 4 wherein said handle means comprises a pair of end handle caps lodged at the pair of opposed ends of the handle means.

* * * * *